US007731672B2

(12) United States Patent
Chiang

(10) Patent No.: US 7,731,672 B2
(45) Date of Patent: Jun. 8, 2010

(54) MASSAGE DEVICE

(75) Inventor: Chi Wu Chiang, Dongguan (CN)

(73) Assignee: Chichun Wu, Dongguan (CN)

( * ) Notice: Subject to any disclaimer, the term of this patent is extended or adjusted under 35 U.S.C. 154(b) by 0 days.

(21) Appl. No.: 11/625,255

(22) Filed: Jan. 19, 2007

(65) Prior Publication Data

US 2007/0299379 A1 Dec. 27, 2007

Related U.S. Application Data

(63) Continuation-in-part of application No. 11/082,016, filed on Mar. 16, 2005, now abandoned.

(30) Foreign Application Priority Data

May 11, 2004 (CN) ..... 2004 2 0456092 U

(51) Int. Cl.
*A61H 15/00* (2006.01)
*A61H 7/00* (2006.01)
*A61H 19/00* (2006.01)

(52) U.S. Cl. ..... 601/112; 98/101; 98/103

(58) Field of Classification Search ..... 601/49, 601/56–60, 84–87, 90, 91, 93, 94, 97–101, 601/103, 112, 113, 115, 116, 124, 126, 127, 601/133–136

See application file for complete search history.

(56) References Cited

U.S. PATENT DOCUMENTS

| | | | | |
|---|---|---|---|---|
| 4,686,967 | A * | 8/1987 | Hashimoto et al. | 601/116 |
| 6,200,282 | B1 * | 3/2001 | Furuie et al. | 601/98 |
| 6,443,917 | B1 * | 9/2002 | Canto | 601/99 |
| 6,808,500 | B1 * | 10/2004 | Cheng-Yi et al. | 601/99 |
| 7,128,721 | B2 * | 10/2006 | Ferber et al. | 601/86 |
| 2003/0009117 | A1 * | 1/2003 | Zou | 601/134 |
| 2003/0199796 | A1 * | 10/2003 | Yamazaki et al. | 601/87 |

* cited by examiner

*Primary Examiner*—Justine R Yu
*Assistant Examiner*—Kristen C Matter
(74) *Attorney, Agent, or Firm*—Morris, Manning & Martin LLP; Tim Tingkang Xia

(57) ABSTRACT

A massage device of the invention includes a base cover, a guiding device formed in the base cover and a moving base movably engaged with the guiding device. The moving base includes a bottom and a shield covered thereon to form a compartment therebetween. The moving base includes a massage system rotatably placed on the shield of the moving base; a first transmission system adapted for moving the moving base along the guiding device and a second transmission system adapted for driving the massage system, both the first and second transmission systems being contained in the compartment and driven individually.

5 Claims, 3 Drawing Sheets

100

MASSAGE DEVICE

CROSS-REFERENCE TO RELATED APPLICATION

This is a continuation in part patent application of the U.S. patent application Ser. No. 11/082,016, filed on Mar. 16, 2005, which is now abandoned. This patent application claims the domestic priority of the U.S. patent application Ser. No. 11/082,016 filed on Mar. 16, 2005, which claims the foreign priority of the Chinese patent application No. 2004200456092 filed on May 11, 2004, the contents of which are incorporated herein in their entireties by reference, respectively.

FIELD OF THE INVENTION

The present invention relates to massage devices with novel structures, and particularly to a massage device using worm to drive worm wheel so as to attain diversiform massage effects.

BACKGROUND OF THE INVENTION

Conventional massage devices, as disclosed in Taiwan Patent No. 238543 and 435223, generally utilize worm to drive two correspondingly configured worm wheels to rotate relative to each other so as to make kneading components eccentrically coupled on the worm wheels to move circularly to perform massage function. At present, the massage devices are usually assembled on neck-massage parts of massage chairs or presented in an individual massage chair. However, the main drawback of the above-mentioned massage devices is that they only provide a single massage effect.

Hence, it is desired to provide a massage device to solve the above-mentioned problems.

SUMMARY OF THE INVENTION

To overcome the above drawbacks of prior art, a main object of the present invention is to provide a massage device which can provide various massage effects.

To attain the above object, a massage device comprises a base cover; a guiding device comprising a plurality of guiding rails positioned in a middle region of the base cover; and a moving base movably engaged with the plurality of the guiding rails of the guiding device. The moving base comprises a bottom and a shield positioned over the bottom to form a compartment therebetween. The moving base further comprises a massage system rotatably placed on the shield of the moving base; a first transmission system adapted for moving the moving base along the plurality of the guiding rails of the guiding device and a second transmission system adapted for driving the massage system, both the first and second transmission systems being contained in the compartment and secured to the moving base. The massage system comprises at least one rotation shelf which has a middle shaft bore defined therein and at least one kneading head rotatably mounted on the at least one rotation shelf. The second transmission system comprises a second motor, a second worm mechanically connected with the second motor, at least one second worm wheel meshing with the second worm and a worm wheel shaft having a first end portion coaxially connected with the at least second worm wheel and an opposite, second end portion mounted in the middle shaft bore of the at least one rotation shelf of the massage system, the at least one rotation shelf with its kneading head being rotated by the worm wheel shaft.

According to an embodiment of the invention, the base cover has a rack formed therein and paralleled to the plurality of guiding rails, and the first transmission system comprises a first motor, a first worm mechanically connected with the first motor, a first worm wheel meshing with the first worm, a small gear mounted under the first worm wheel, a big gear, an intermediary gear meshing with both the small gear and the big gear, and a driving gear mounted under the big gear and meshing with the rack of the base cover. The first and second motors are set in a certain angle.

The moving base further comprises at least one power supply mounted between the bottom and the shield and adapted for activating the first and second motors individually or cooperatively.

In one embodiment, the number of the second worm wheels of the second transmission system is two, the two second worm wheels being simultaneously driven by the second worm, and the number of the rotation shelves of the massage system is two, the worm wheel shafts having their top ends mounted in the middle shaft bores of the respective rotation shelves.

In one embodiment, the number of the kneading heads of the rotation shelf is two, and the kneading heads are symmetrically mounted on both sides of the middle shaft bore of the rotation shelf. In addition, the kneading heads are of a mushroom-shape.

The invention, among other things, has the following advantages comparing to the prior art, through the rotation of the at least one kneading head transmitted by the second worm, the second worm wheel, and the worm wheel shaft of the second transmission system and the movement of the moving base, transmitted by the first transmission system, along a curved guide rail corresponding to the outline of people's back, the massage device of the invention can better imitate the motion of the manual massage to achieve the imitation effect of the manual massage. Additionally, according to the invention, both the first and second transmission systems in the invented massage device can operate individually. This makes it possible for the massage device to provide kneading and massage effect on different parts (regions) of a human body operating the first transmission system to move the moving base (the massage system) to the regions of interest of the human body, then operating the second transmission system to provide the kneading and massage effects thereon. The operation frequency of the massage device can be regulated as required by the person to give a gentle massage effect. The fixed bolt is added to the massage device to prevent the movement of the moving base when it is unused, which make it easy to move, deposit and have a high security to avoid unusual work electricity.

For the purpose of making the invention easier to understand, several particular embodiments thereof will now be described with reference to the appended drawings in which:

DETAILED DESCRIPTION OF THE INVENTION

Figure 1:
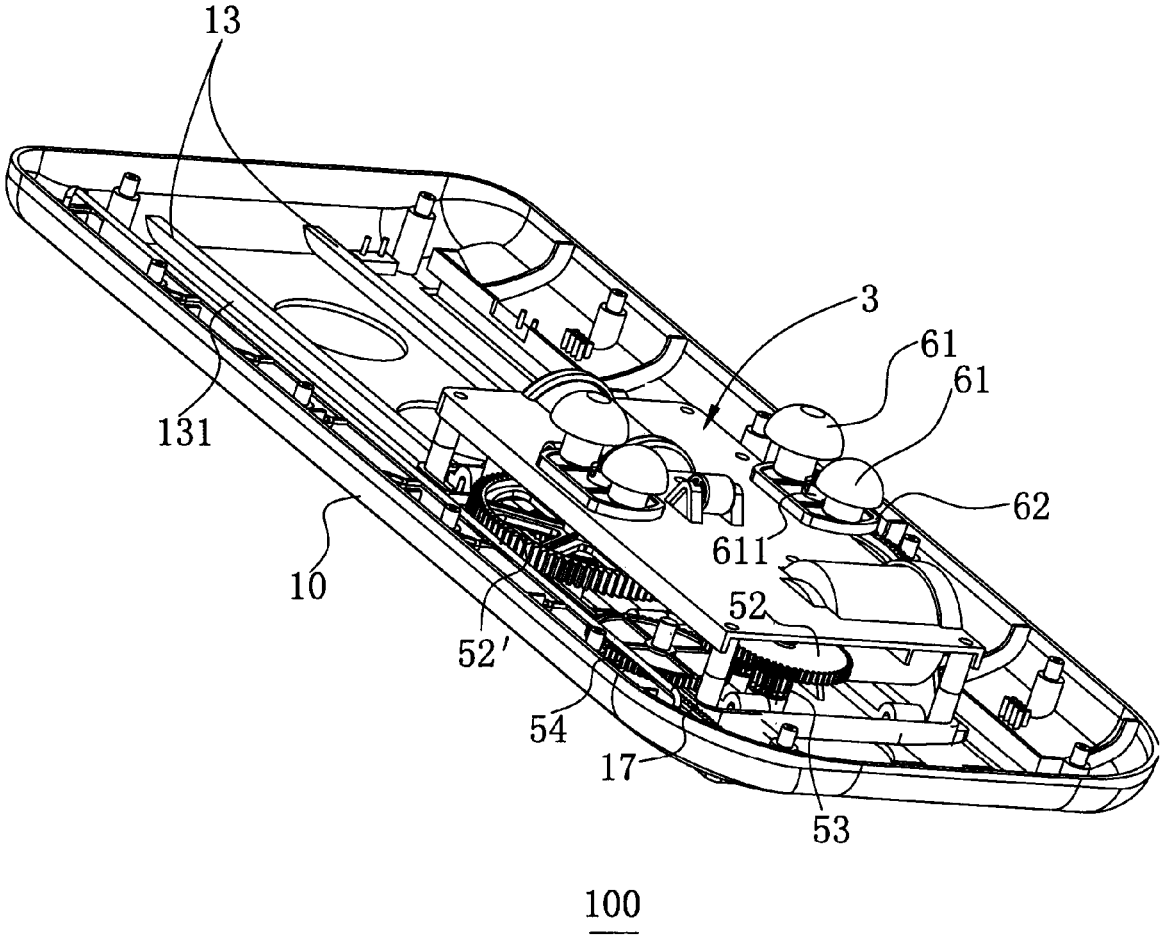
FIG. 1 is a perspective view of a massage device according to an embodiment of the invention.
Figure 2:
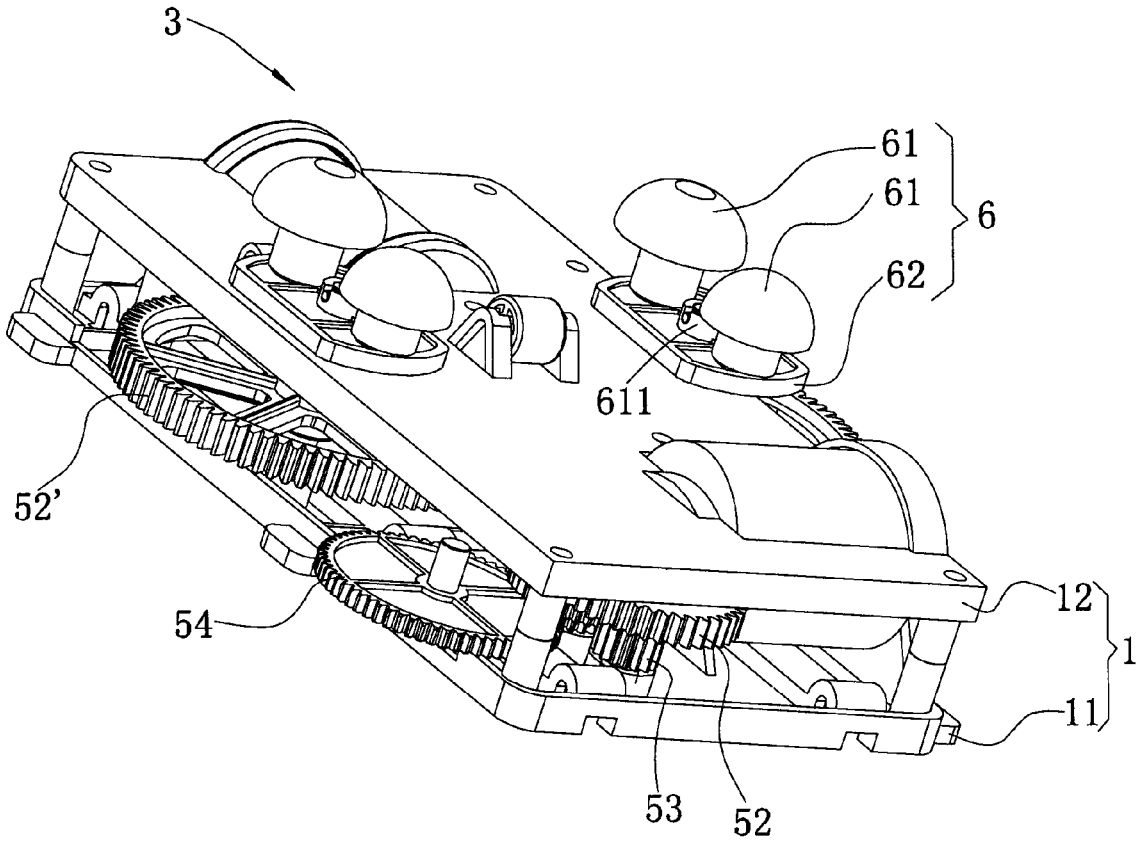
FIG. 2 is a perspective view of a moving base of the massage device shown in FIG. 1.
Figure 3:
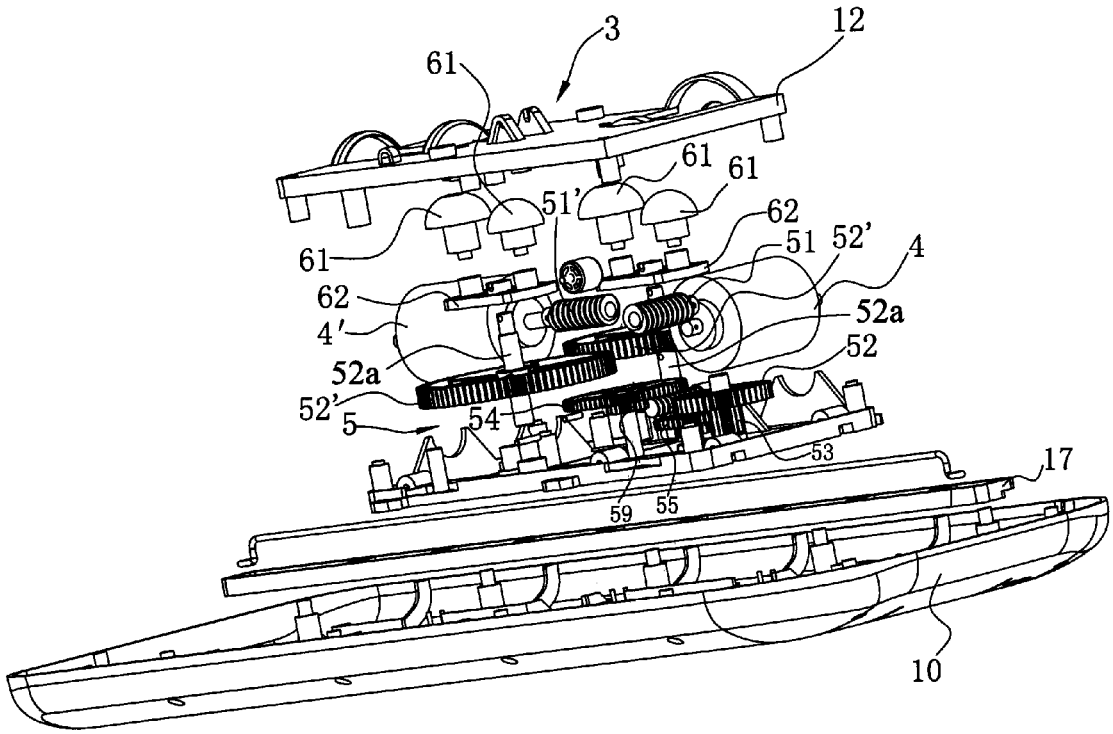
FIG. 3 is an exploded, perspective view of the massage device shown in FIG. 1.

Referring to FIGS. 1-3, according to an embodiment of the invention, a massage device 100 comprises a base cover 10, a guide device 13 and a moving base 3. The base cover 10 comprises a rack 17 for driving the moving base 3 to move along the guide device 13. The guide device 13 is constituted by a plurality of guide rails 131 positioned in the middle region of the base cover 10. The moving base 3 comprises a bottom 11 and a shield 12 positioned over the bottom 11 to collectively form a compartment or chassis 1. The moving base 3 is movably engaged with the guide device 13 and can move in an area defined by the guide device 13.

The moving base 3 further comprises a first transmission system for moving the moving base 3 along the guide device 3, a second transmission system and a massage system 6 for providing massage effect to a person. The first and second transmission systems are both mounted to the moving base between the bottom 11 and the shield 12 of the moving base 3, i.e., both the first and second transmission systems are contained in the compartment 1 thereof. The first transmission system comprises a first motor 4, a first worm 51 mechanically connected with the first motor 4, a first worm wheel 52 meshing with the first worm 51, a small gear 53 mounted under the first worm wheel 52, a big gear 54, an intermediary gear 55 meshing with both the small gear 53 and the big gear 54, and a driving gear 59 mounted under the big gear 74 and meshing with the rack 17 of the base cover 10. The second transmission system comprises a second motor 4, a second worm 51' mechanically connected with the second motor 4', a pair of second worm wheels 52' meshing simultaneously with the second worm 51' and a pair of worm wheel shafts 52*a* coaxially connected with the respective second worm wheels 52'.

More specifically, the first and second motors 4 and 4' are set in a certain angle. The first motor 4 is coupled with the first worm 51 on its output end and the second motor 4' is coupled with the second worm 51' on its output end. The first worm wheel 52 is driven in-phase by the first worm 51 of the first transmission system. The pair of second worm wheels 52' is driven in-phase by the second worm 51' of the second transmission system so that the pair of second worm wheels 52' will rotate simultaneously in an opposite direction when driven by the second worm 51'. The first and second worm wheels 52 and 52' are all pivoted in the moving base 3 comparatively.

The massage system 6 is rotatable mounted on the shield 12 of the moving base 3. The massage system 6 comprises a pair of rotation shelves 62 each having a middle shaft bore 611 defined therein. Each rotation shelf 62 has a pair of kneading heads 61 mounted thereon. The pair of kneading heads 61 are symmetrically provided on both sides of the middle shaft bore 611 of the respective rotation shelf 62. In one embodiment, each of the kneading heads 61 has a shape of mushroom. Each worm wheel shaft 52*a* of the respective second worm wheel 52' has its top end mounted in the corresponding middle shaft bore 611 of each rotation shelf 62 of the massage system 6.

In operation, firstly, power is supplied to the first and second motors 4 and 4' so as to activate the first and second motors 4 and 4' individually or cooperatively; then the activations of the motors 4 and 4' drive the first and the second transmission systems, respectively. The second worm 51' connected with the second motors 4' drives the pair of second worm wheels 52' to make them rotate in opposite directions. In the invention, the rotation shelves 62 are rotated along with the pair of second worm wheels 52' respectively due to being fixed thereon. Then, the kneading heads 61 provided on the respective rotation shelves 62 are rotated along with the rotation of the rotation shelves 62. In the meantime, the kneading heads 61 itself are rotated. In operation, when a person has its back rested against the kneading heads 61, he/she will receive back-kneading effects on his/her back. In the embodiment, because the two second worm wheels 52' rotate in counter-direction and the kneading heads 61 are comparatively set on the rotation shelves 62, the pressure exerted to the person can be changed so as to achieve an imitated manual massage effect. When the first worm wheel 52 rotates, the rotation of the first worm wheel 52 is transmitted with speed-down to the big gear 54 through the small gear 53 and the intermediary gear 55. The driving gear 59 provided under the big gear 54 is thus joggled with the rack 17 so as to drive the moving base 3 to move on the back of a person and attain an imitated manual massage therefrom. The guide rails 131 are used for guiding the moving base 3 and making its movement smoothly. The two motors 4, and 4' are controlled by circuit of the massage device 100 to make them operate individually or cooperatively, thus achieving various massage effects.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A massage device comprising:

a base cover having a rack formed therein;

a guiding device comprising a plurality of guiding rails formed in a middle region of the base cover and paralleled to the rack; and a moving base movably engaged with the plurality of the guiding rails of the guiding device, comprising a bottom, a shield positioned over the bottom to form a compartment therebetween, a massage system rotatably placed on the shield, a first transmission system adapted for moving the moving base along the plurality of the guiding rails of the guiding device and a second transmission system adapted for driving the massage system to provide massage effects, both the first and second transmission systems being contained in the compartment and being driven individually, wherein the massage system comprises a pair of rotation shelves each defining a middle shaft bore therein and a plurality of kneading heads rotatably mounted on the pair of rotation shelves;

the first transmission system comprises a first motor, a first worm mechanically connected with the first motor, a first worm wheel meshing with the first worm, a small gear coaxially mounted under the first worm wheel, a big gear, an intermediary gear directly meshing with both the small gear and the big gear, and a driving gear coaxially mounted under the big gear and meshing with the rack of the base cover such that when the first motor is activated, it drives the first worm to rotate, the rotation of the first worm results in, in turn, the rotation of the small gear, the intermediary gear, the big gear and the driving gear, thereby moving the moving base along the plurality of the guiding rails of the guiding device, wherein the movement of the moving base causes the plurality of kneading heads of the massage system to translate along the plurality of the guiding rails of the guiding device; and the second transmission system comprises a second motor, a second worm mechanically connected with the second motor, a pair of second worm wheels mechanically and directly meshing with the second worm and a pair of worm wheel shafts each having a first end portion coaxially connected with a respective second worm wheel of the pair of second worm wheels and an opposite, second end portion extending through the shield of the moving base and secured into the middle shaft bore of a respective rotation shelf of the pair of rotation shelves of the massage system, such that when the second motor is activated, it drives the second worm to rotate, the rotation of the second worm results in the rotation of the pair of second worm wheels in opposite directions simultaneously and cooperatively, which in turn, results in the rotation of the pair of worm wheel shafts in the opposite directions simultaneously and cooperatively, thereby simultaneously and cooperatively rotating the pair of rotation shelves in the opposite directions with the plurality of kneading heads to provide kneading and/or massage effects on the left side and the right side of a user's back simultaneously and cooperatively, wherein the moving base further comprises at least one power supply mounted between the bottom and the shield for selectively activating the first and second motors individually or cooperatively, whereby the translation and rotation of the plurality of kneading heads selectively occurs independently or simultaneously.

2. The massage device as claimed in claim 1, wherein the first and second motors are set in a certain angle.

3. The massage device as claimed in claim 1, wherein the plurality of kneading heads comprises two pairs of kneading heads, and each pair of kneading heads are symmetrically mounted on both sides of the middle shaft bore of a respective rotation shelf of the pair of rotation shelves.

4. The massage device as claimed in claim 3, wherein the kneading heads are of a mushroom-shape.

5. The massage device as claimed in claim 1, wherein the plurality of guiding rails has a curved profile complementary to the outline of a user's back.

* * * * *